US006851211B2

(12) United States Patent
Sender

(10) Patent No.: US 6,851,211 B2
(45) Date of Patent: Feb. 8, 2005

(54) CEILING MOUNTED DISPLAY SIGN

(76) Inventor: Ed Sender, 441 W. Rand Rd., Mount Prospect, IL (US) 60090

( * ) Notice: Subject to any disclaimer, the term of this patent is extended or adjusted under 35 U.S.C. 154(b) by 150 days.

(21) Appl. No.: 10/103,388

(22) Filed: Mar. 21, 2002

(65) Prior Publication Data

US 2003/0177680 A1 Sep. 25, 2003

(51) Int. Cl.[7] ..... G09F 7/22
(52) U.S. Cl. ..... 40/617; 40/431
(58) Field of Search ..... 40/617, 430, 431, 40/473, 553

(56) References Cited

U.S. PATENT DOCUMENTS

| | | | | | |
|---|---|---|---|---|---|
| 4,290,218 | A | | 9/1981 | Drueck, Jr. | 40/553 |
| 4,528,764 | A | | 7/1985 | Cobb | 40/553 |
| 4,947,570 | A | | 8/1990 | May et al. | 40/553 |
| 5,025,355 | A | * | 6/1991 | Harwood | 40/553 X |
| 5,044,103 | A | | 9/1991 | Izenberg | 40/617 |
| 5,128,850 | A | | 7/1992 | Juodvalkis | |
| 5,274,938 | A | | 1/1994 | McDonald et al. | 40/617 |
| 5,282,331 | A | | 2/1994 | Fell | 40/617 |
| 5,355,604 | A | | 10/1994 | Rathke | 40/601 |
| 5,772,314 | A | | 6/1998 | Brumer | |
| 6,397,531 | B1 | * | 6/2002 | Martin | 40/617 X |

FOREIGN PATENT DOCUMENTS

| | | | | |
|---|---|---|---|---|
| FR | 2636222 | * | 3/1990 | 40/430 |

OTHER PUBLICATIONS

"AMF Bowling Products Guide" Web Page published on the World Wide Web at http://www.iass.com/amflec.html believed published Circa 2001, showing "Ceiling Light Thief Display".

* cited by examiner

*Primary Examiner*—Joanne Silbermann
(74) *Attorney, Agent, or Firm*—Greer, Burns & Crain, Ltd.

(57) ABSTRACT

A display sign for suspension from a ceiling has a ceiling mount with a passage extending therethrough. A turntable is rotatably held in the passage, with a graphic holder attached to the turntable and thereby rotatably mounted below the sign mount. The display sign may be mounted in a ceiling below a light fixture so that the display holder will be illuminated.

15 Claims, 11 Drawing Sheets

CEILING MOUNTED DISPLAY SIGN

FIELD OF THE INVENTION

The present invention is related to display signs that may be suspended from a ceiling.

BACKGROUND OF THE INVENTION

Signs for displaying information such as promotional information are generally known. In particular, one class of such signs comprises displays that may be suspended from a ceiling for displaying information such as point of purchase advertising. Some signs may be adapted for suspension from a ceiling of the type that has a latticework of crossing members for holding ceiling tiles. Signs that are known in the art as "light thief" signs are so adapted, and may be suspended below a portion of the ceiling housing a light source, with the light from the source used to illuminate display panels of the sign.

The display panels may, for example, drop generally vertically or at an angle from the ceiling, so that they are visible to one looking from the floor towards that portion of the ceiling. A particular sign may comprise two or more display panels, with an example being a light thief sign that has four panels arranged about its periphery in a generally square or rectangular fashion.

The lattice work used to support the ceiling tiles and display signs in such circumstances is generally in the form of a grid, with one set of lattice members placed along what may be though of as an X axis, and a second set of members along what may be thought of as a Y axis perpendicular to the X axis. The ceiling lattice thereby creates a grid with a plurality of substantially square or rectangular "grid cells" created between intersecting X and Y axis lattice members. Each of these grid cells generally holds a ceiling tile, with an occasional clear or translucent panel such as plastic being placed in a cell below a light fixture. Generally, light thief signs are used to replace these clear panels.

As such, light thief displays as known are generally limited to placement depending on the lattice grid. That is, light thief display panels are generally limited to an orientation of display that is determined by the lattice ceiling grid orientation. By way of example, if a light thief display has four display panels oriented in a generally square manner, the panels will be displayed parallel to the X and Y axis of the ceiling lattice when the light thief is installed.

Often, this proves disadvantageous. For example, consider a store having a substantially square floor plan with a liquor department in one corner of the store. The main entry door to the store is at the opposite corner of the store. Further assume that a liquor vendor desires to use a light thief to display promotional advertisements using a light thief in the liquor department. Because the panels of the light thief run parallel to the ceiling lattice, however, the display panels are not oriented to the main entry to the store that is diagonal to the location of the liquor department. Disadvantageously, then, consumers entering the store may not be able to easily read or even see the display panels.

Unresolved needs in the art therefore remain.

SUMMARY OF THE INVENTION

The present invention is directed to display signs for mounting from a ceiling. One embodiment of the present invention comprises a display sign for suspension from a ceiling of the type that has a plurality of ceiling grids, comprising a sign mount adapted for mounting in one of the ceiling grids, the sign mount having a passage, a turntable rotatably held in the passage, and a graphic holder for displaying graphics connected to the turntable and rotatably held below the sign mount.

Embodiments of the present invention thereby provide a display sign for mounting from a ceiling that may advantageously be rotated as desired. That is, an embodiment of the invention provides a display sign of the type that is mounted in a ceiling grid that may be rotatably oriented for display regardless of its relative orientation to the ceiling lattice grid. Otherwise unresolved problems of the prior art are thereby resolved by embodiments of the present invention.

The above brief description sets forth broadly some features of the present disclosure so that the detailed description that follows may be better understood, and so that the present contributions to the art may be better appreciated. Before explaining an embodiment of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DETAILED DESCRIPTION

Figure 1:
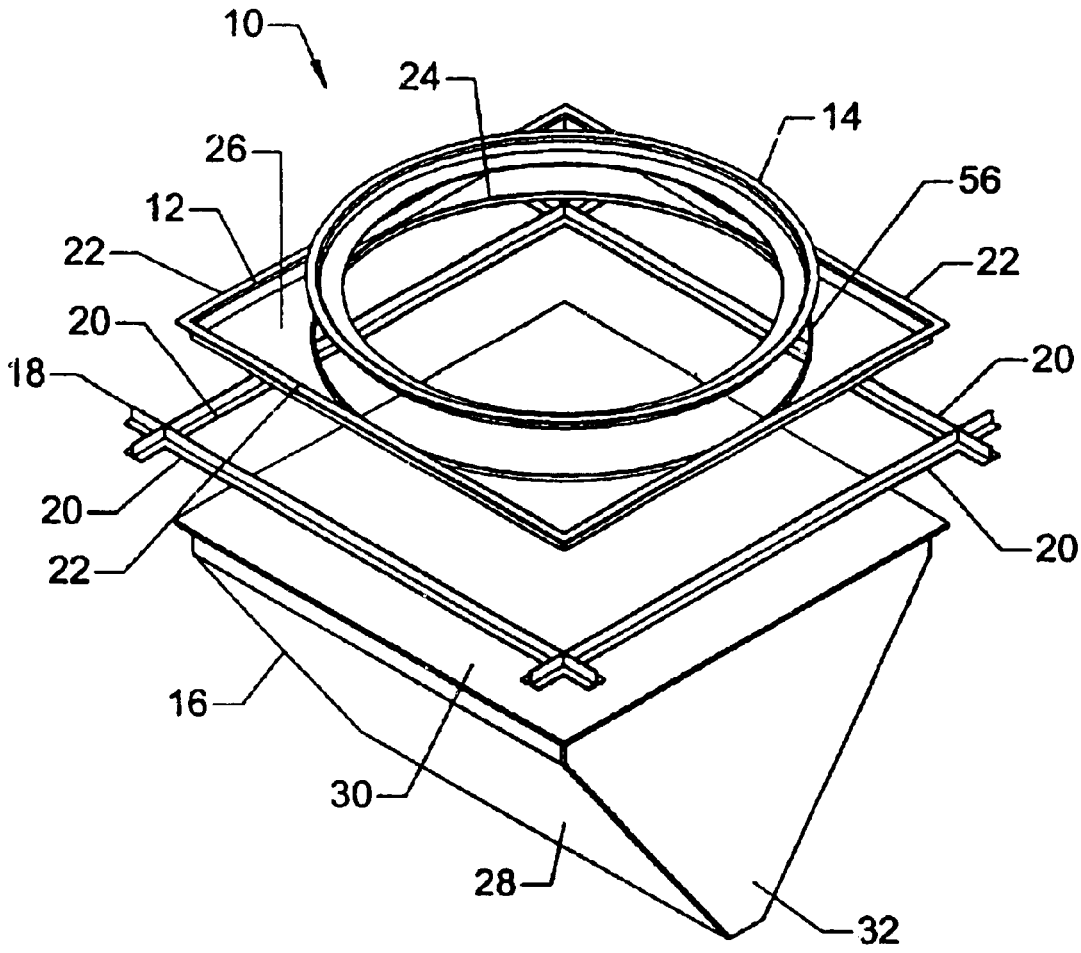
FIG. 1 is an exploded perspective view of a display sign embodiment of the invention.
Figure 2:
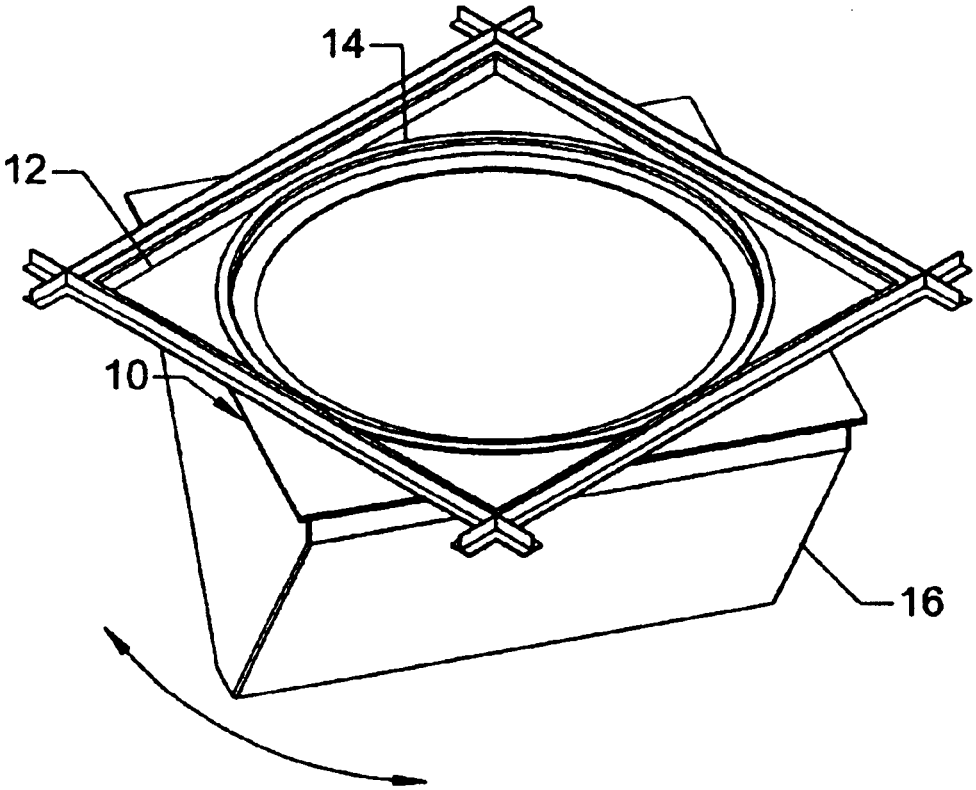
FIG. 2 is a perspective view of the assembled display sign embodiment of FIG. 1.
Figure 3:
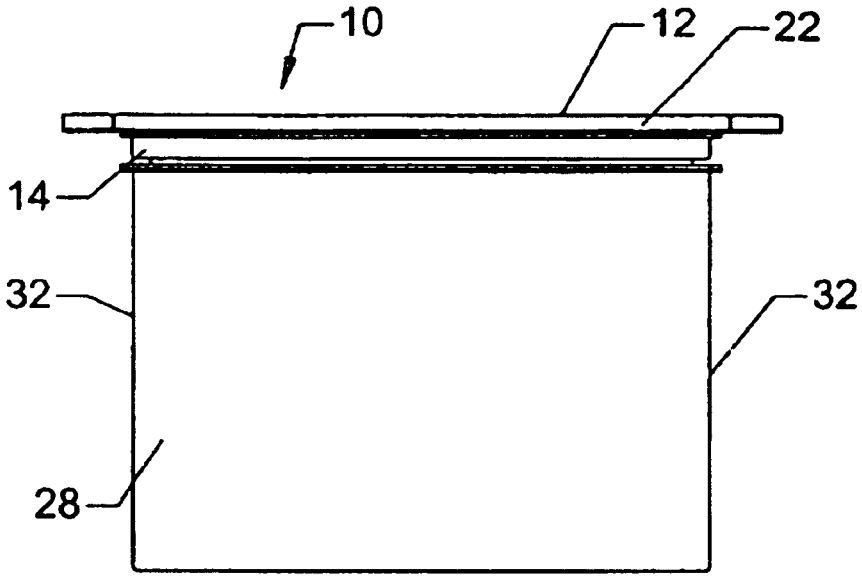
FIG. 3 is a side elevation of the embodiment of FIG. 1.
Figure 4:
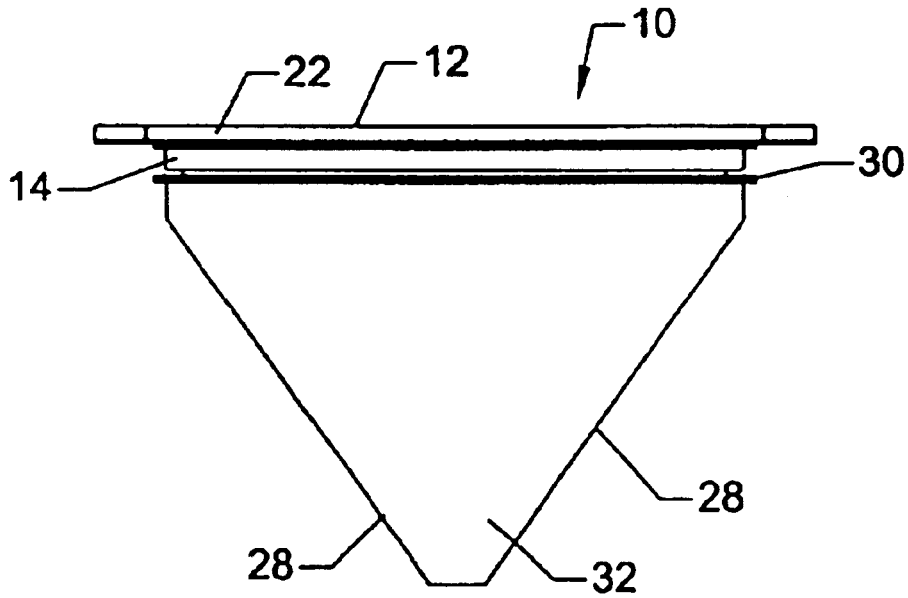
FIG. 4 is an end elevation of the embodiment of FIG. 1.

Turning now to the drawings in order to describe the best known modes of practice of the present invention, FIG. 1 is an exploded perspective view of an embodiment of a display sign 10 of the present invention. FIG. 2 is a perspective view of the assembled display sign 10, FIG. 3 is an elevation view of the display sign 10 viewed along one side, and FIG. 4 is an elevation view viewed along an end. The display sign 10 comprises a sign mount 12, a turntable 14, and a graphic holder 16. The sign mount 10 is adapted for mounting in a ceiling grid 18, which although shown in FIG. 1 for purposes of illustration, will be understood to not be a part of the present invention. The ceiling grid 18 is comprised of intersecting lattice members 20, which may be thought of as generally extending along an X and a Y axis.

The sign mount 12 has four sides 22, with each side 22 adapted to be held by one of the lattice members 20. The sign mount also has a substantially circular passage 24 passing through a bottom wall 26, with the turntable 14 rotatably held in the passage 24 when the display sign is assembled as best illustrated by FIG. 2. The graphic holder 16 is connected to the turntable 14 and thereby rotatably held below the sign mount 12. The graphic holder 16 has two side panels 28 that descend in a narrowing "V" shape from a top wall 30, and two "V" shaped end panels 32. As best illustrated by FIG. 2, when assembled the graphic holder 16 is rotatable relative to the sign mount 12 through rotation of the turntable 14. Preferably, rotation about 360° is allowed, although lesser amounts of rotation may be useful for other invention embodiments.

Figure 5:
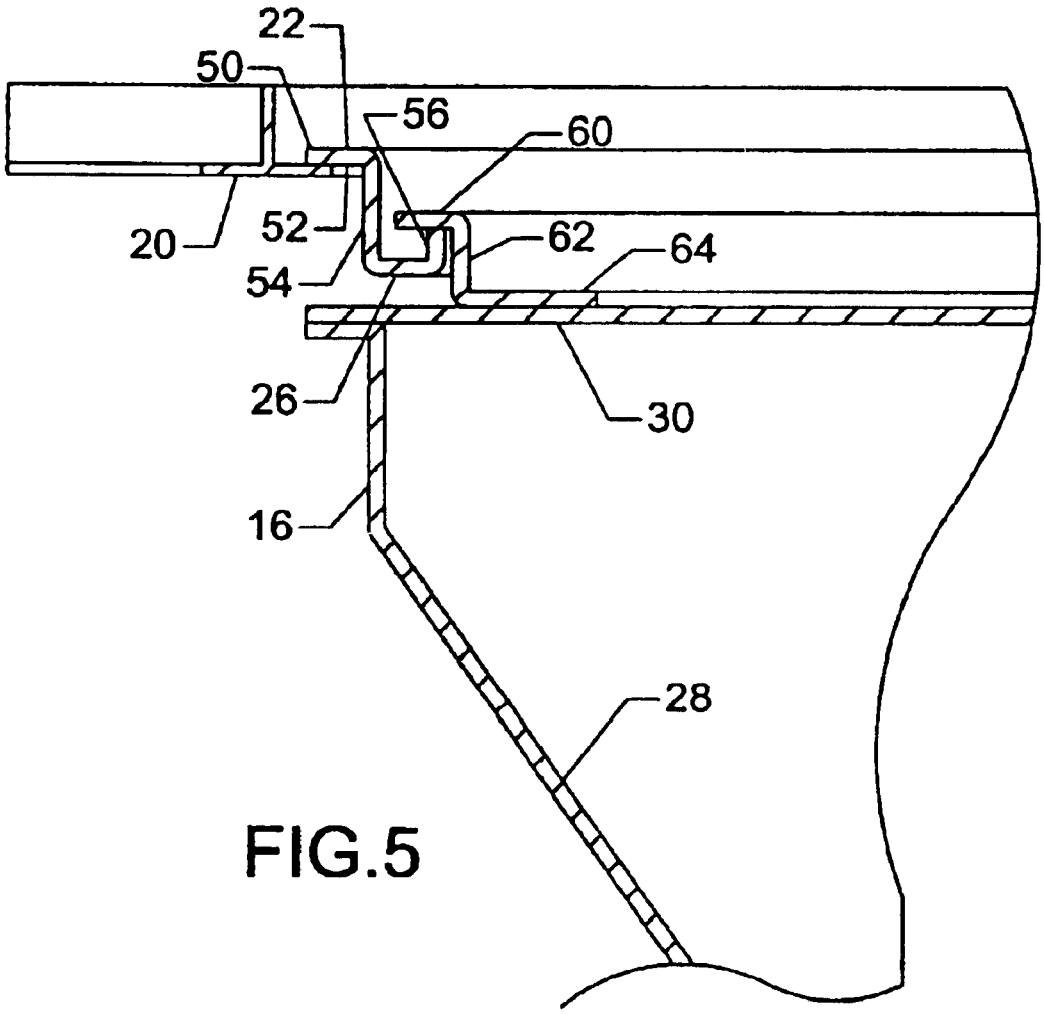
FIG. 5 is a cross section of a portion of the embodiment of FIG. 1.

The cross section of FIG. 5 illustrates in greater detail the manner of connection of the sign mount 12, ceiling grid lattice member 20, the turntable 14, and the graphics holder 16 for this invention embodiment. Each side 22 of the sign mount 12 has a shoulder 50 for abutting the ceiling grid lattice member 20. In particular, it will be appreciated that the lattice member 20 may be substantially shaped as an inverted "T" so as to support ceiling panels and light panels. The shoulder 50 has a flat bottom surface 52 for resting on the flat portion of the lattice member 20. A side wall 54 descends from the shoulder 50, with a bottom wall 26 connected to the bottom of the side wall 54. A substantially circular rim wall 56 rises from the bottom wall 26 to define the circular passage 24.

The turntable 14 has a top annular shoulder 60 for rotatably engaging the sign mount 12 proximate the circular passage 24. Specifically, the shoulder 60 movably engages the top of the sign mount rim wall 56. Although illustrated as being annular, it will be appreciated that other embodiments of the invention may comprise a top shoulder that is not annular and/or not continuous. By way of example, a top shoulder may be comprised of a plurality of individual tabs or other members spaced about the perimeter of the turntable for engaging the sign mount.

An annular side wall 62 descends from the top annular shoulder 60, with a bottom annular shoulder 64 connected to the bottom of the annular side wall 62. The annular side wall 62 has a diameter, as does the passage 24. The diameter of the annular side wall 62 is smaller than that of the passage 24, so that the annular side wall 62 is spaced apart by some distance from the rim wall 56. It will be appreciated that this is advantageous in that frictional contact may be avoided between the two walls for ease of rotation. The top wall 30 of the graphic holder 16 is connected to the bottom annular shoulder 64 of the turntable 14.

The interior portion of the turntable 14 may be open so that light will not be diminished as it passes therethrough from a ceiling light fixture. The top wall 30 of the graphic holder may likewise have an open space near its center and past a region sufficient for attachment to the turntable bottom annular shoulder 64 for effective passage of light. These areas may also be comprised of a clear or translucent material such as a thermoplastic, however. In particular, it may be desirable to provide a top wall 30 of the graphic holder comprised of a sheet of thermoplastic material for structural strength.

Also, it will be appreciated by those skilled in the art that the top of the graphic holder 16 may be substantially completely open, with only mounting arms, tabs or other means comprised for attachment to the turntable 14. By way of example, flat cross bars may span the top of the graphic holder 16 in an X or other configuration for attachment to the turntable 14. Such a configuration may be desirable in that it is lightweight, allows for efficient passage of light, and yet provides good structural support for the graphics holder 16. Further, it will be appreciated that other invention embodiments may comprise a turntable having a bottom shoulder that is not annular, but may instead comprise individual tabs, cross members, or the like, that are spaced about the perimeter of the turntable annular wall 62. Such a configuration may be desirable to provide for a lightweight construction, and for improving thee passage of light from a light fixture through the turntable.

Other invention embodiments may further comprise connection means for releasably attaching the graphic holder 16 to the turntable 14. Indeed, it will be appreciated that it may be advantageous to change the graphic display of a display sign of the invention from time to time. For example, it may be desired to use a display sign of the invention to advertise seasonal items, with the display accordingly changed each season. Rather than changing the entire assembly, it may be cost effective to change the graphic holder only. Other invention embodiment may therefore provide releasable attachment means for attaching the graphic holder to the turntable such as clamps, snaps, mating hook and loop strips such as Velcro, screw attachments, levered attachments, mating stud and hole connectors, and the like. These connection means may be used, for example, to removably attach a graphic holder 16 to the annular wall 62 of the turntable, or to the annular shoulder 64.

Still other invention embodiments may comprise a graphic holder 16 that has means for inserting and removing display sheets. By way of example, the sidewalls 28 may comprise envelope like enclosures into which desired display sheets can be slid. Further, the sidewalls 28 may comprise panels over which display signs are attached using side or end clips, adhesives, Velcro, or the like. Displays may of course also be provided on the end panels 32.

FIGS. 10–13 illustrate example means for removable attaching display panels. In particular, the graphic holder 316 comprises means for removably attaching graphics sheets 317 to the graphics holder 316. A plurality of channels 370 is provided running along one or more of the edges of the graphics holder sides 328 and ends 332. The channels 370 are shown in greater detail in the perspective view of FIG. 11 and the cross section of FIG. 12. Each channel 370 comprises a substantial "U" or "hook" shape, with the back surface useful surface for attachment to the side wall 328 or end wall 332 with adhesive or the like. Edges of the graphic sheet 317 will be received in the interior of the hook or U-shaped channel 370.

The channels 370 may run along one or more edges of the side walls 328 and the end wall 332. In the display sign embodiment 310, the channels have been placed along the sides vertical of the V-shaped end wall 332, and along the vertical sides and bottom edge of the side wall 328. To further secure the graphics sheets 317, push pins 372 are provided. The push pin 372 is also shown in the cross section of FIG. 13 in place and securing the display sheet 317 to the end wall 332. Those knowledgeable in the art will appreciate that a push pin 372 generally comprises an elongated member having a head 378 and a distal end 380 sized to be just larger than the receiving passage 376 so that it may be pushed or pulled through the receiving passage 376 with pressure, but will otherwise remain in place. The head 378 is sized substantially larger than the receiving passage 374 on the display sheet 317 so that the sheet 317 will be held in place.

Those knowledgeable in the art will appreciate that channels 370 and push pins 372 of the embodiment 310 may be advantageous in that the display sheets 317 are attached to the display sign 316 in such a way as to minimize shadows or "dark spots" on the display sheets that might arise should Velcro or other attachment means be used that required attachment to a portion of the surface area of the display sheet 317. Those knowledgeable in the art will likewise appreciate that although the embodiment 310 has been illustrated using a particular combination of channels 370 and push pins 372, other invention embodiments may comprise different combinations. By way of example, the display sheet 317 could be attached to the display sign 332 using a plurality of push pins and no channels 370, or with only a plurality of channels 370 and no push pins 372.

With reference once again made to the embodiment 10 as well as 310, it will further be appreciated that the general "V" shape with flat end walls 32 of the graphic holder 16, and 332 of the graphic holder 316, respectively, represents only one example shape for graphic holders that will be useful for practice of the invention. Indeed, those knowledgeable in the art will appreciate that any of a wide variety of graphic holders are conceivable within the present invention, with examples including graphic holders having a shape that is substantially square, triangular, other polygons, cylindrical, spherical, an inverted pyramid, and even a substantially flat two-sided panel of any desired shape.

Figure 6:
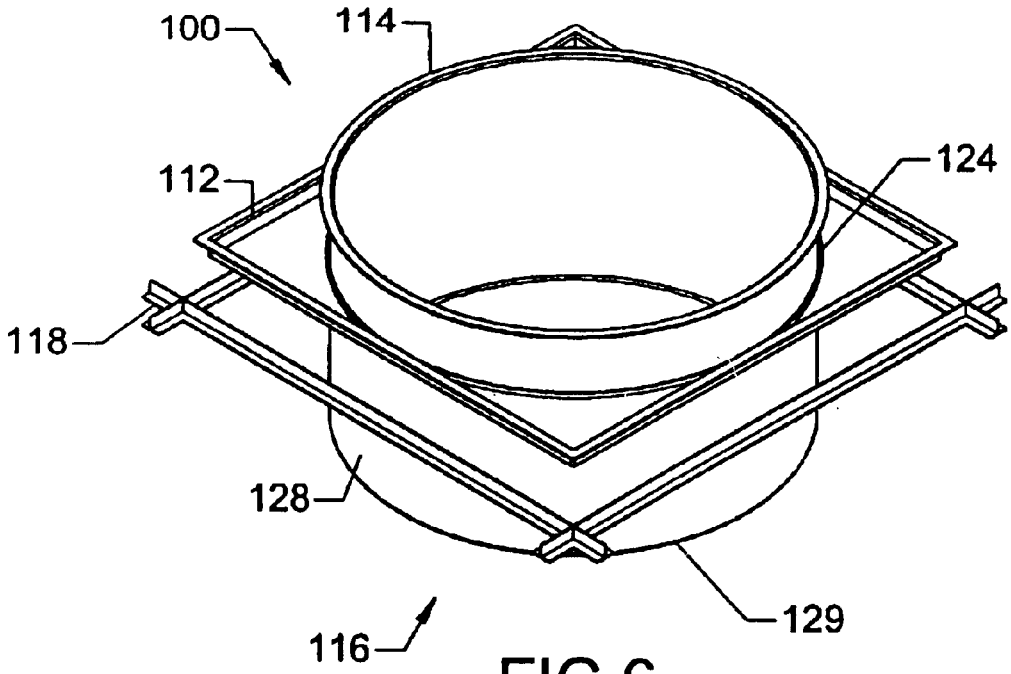
FIG. 6 is an exploded perspective of a second invention embodiment.

By way of particular example, reference is made to the cylindrical display sign 100 of FIG. 6. The display sign 100 is similar in many respects to the sign 10 of FIGS. 1–5, with a sign mount 112 for mounting in a ceiling grid 118 (not part of the invention, but illustrated for clarity) and having a passage 124 through its bottom wall 126. A turntable 114 is rotatably held in the passage 114. A substantially cylindrical graphics holder 116 is connected to the turntable 114 and rotatably held below the sign mount 112. The graphics display 116 is preferably rotatable about 360° relative to the sign mount 112, and generally comprises a cylindrical side wall 128 and a bottom panel 129. It will be appreciated that the embodiment 100 may comprise means for removably attaching a graphics sheet, with an example comprising a channel running along the bottom edge of the sidewall 128. For ease of use, two semi-cylindrical graphics sheets may be provided, with means for holding these in place comprising channels that are placed vertically as well as along sidewall 128 bottom edge.

Figure 7:
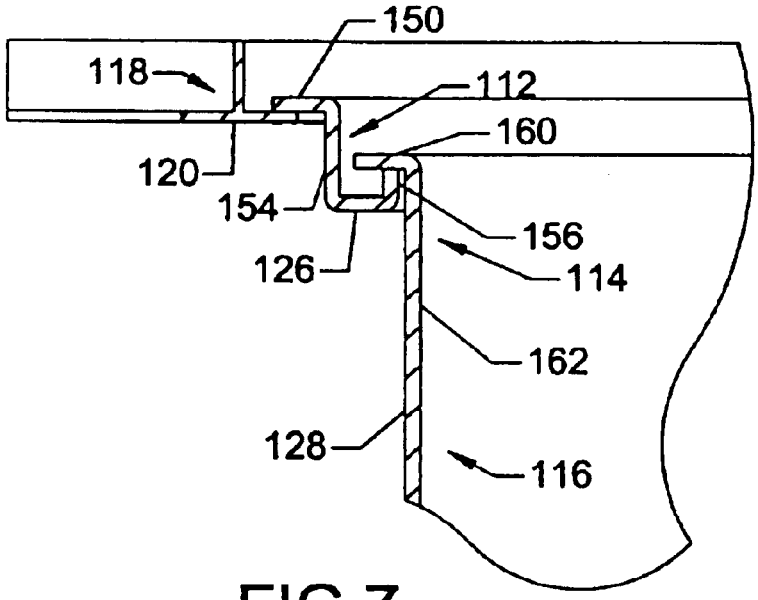
FIG. 7 is a cross section of a portion of the embodiment of FIG. 6.

The cross section of FIG. 7 illustrates in greater detail the manner of mounting of the sign mount 112 in the ceiling grid 118, and the connection of the turntable 114 to the sign mount 112. In considering FIG. 7, it will be appreciated that the sign mount 112 is substantially consistent with the sign mount 12 of the display sign 10 of FIGS. 1–5. It has been described using different element numbers in FIGS. 6–7, however, for clarity. Referring now to FIG. 7, the sign mount has a shoulder 150 for placement on the ceiling grid 18 lattice member 120. A side wall 154 descends from the shoulder 150, and is connected below to a bottom wall 126 of the sign mount. A substantially circular rim wall 156 rises from the bottom wall 154.

The turntable comprises a top shoulder 160 that movably rests on top of the sign mount rim wall 156. Other embodiments may comprise a connection configuration whereby the top shoulder rotatably engages the bottom wall 126 (i.e., no rim wall 156). An annular side wall 162 descends from the shoulder 160, and is connected to the graphics holder 116. In the display sign embodiment 100, the graphics holder 116 may be integral with the turntable 114. As such, the turntable annular wall 162 is substantially continuous with the graphics display sidewall 128. Other embodiments of the invention may of course comprise a cylindrical graphics holder 116 that is separate from the turntable 114, and attached thereto using adhesive, mechanical, or other connector means.

Figure 8:
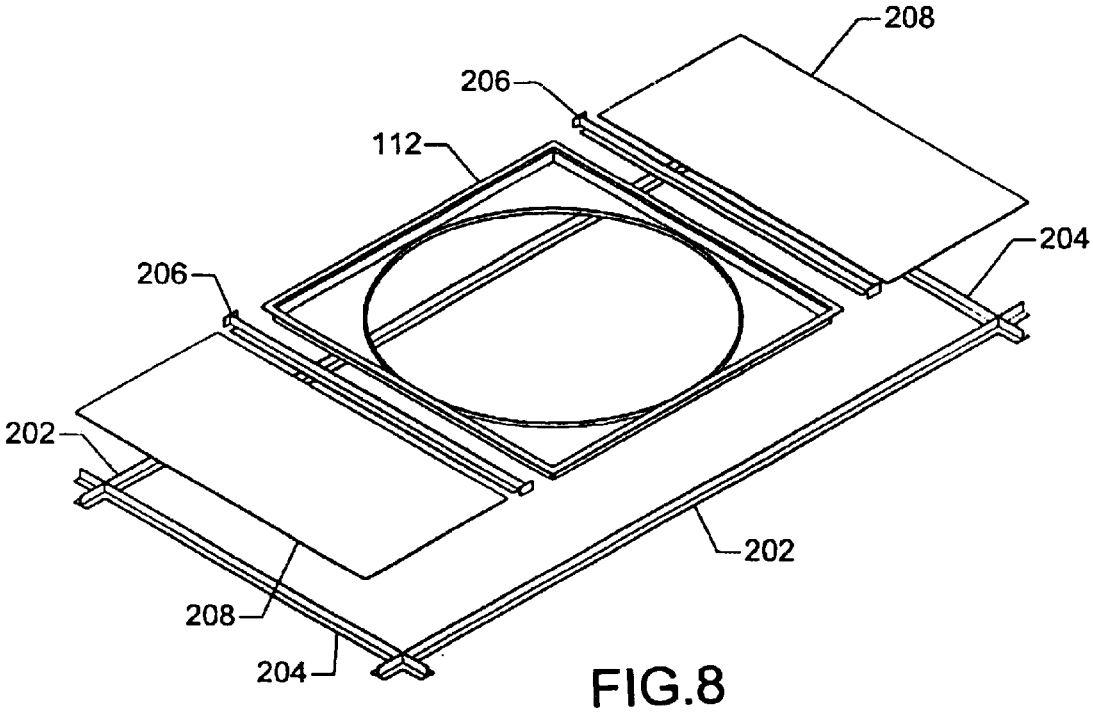
FIG. 8 is a perspective of an additional invention embodiment.
Figure 9:
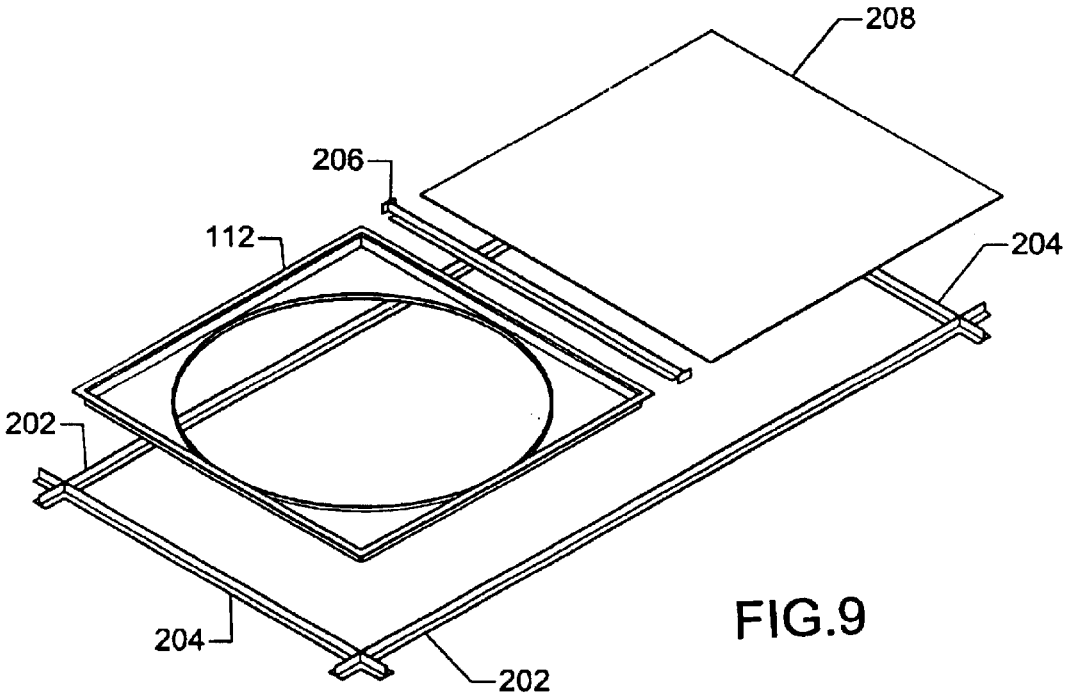
FIG. 9 is a perspective of an additional invention embodiment.
Figure 10:
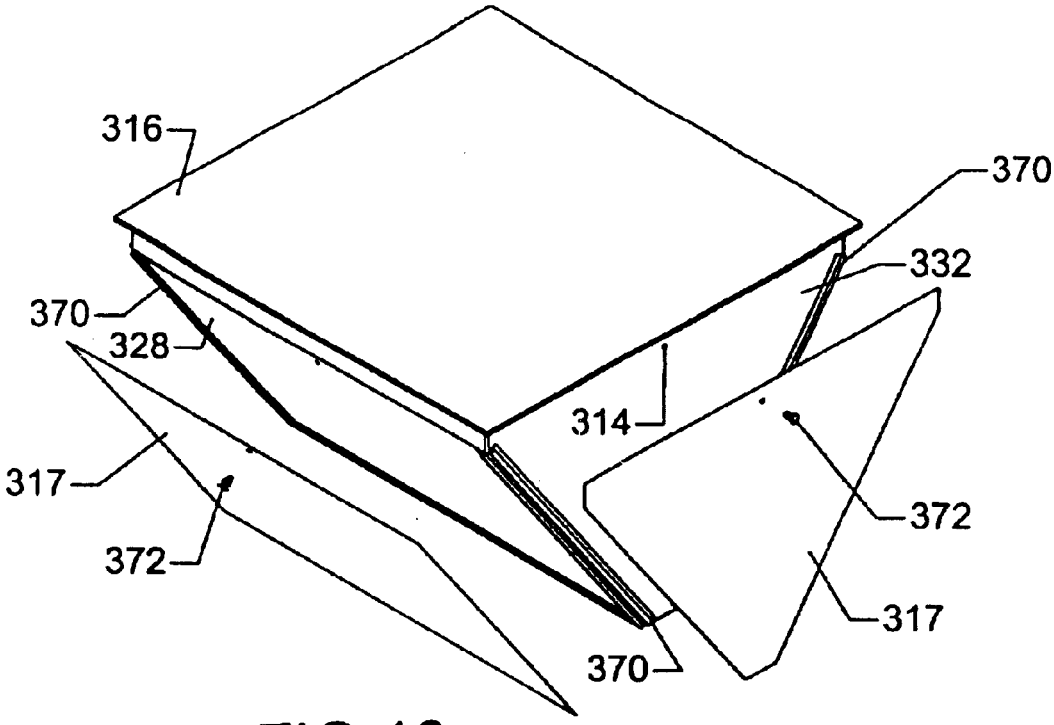
FIG. 10 is an exploded perspective of an additional invention embodiment.
Figure 11:
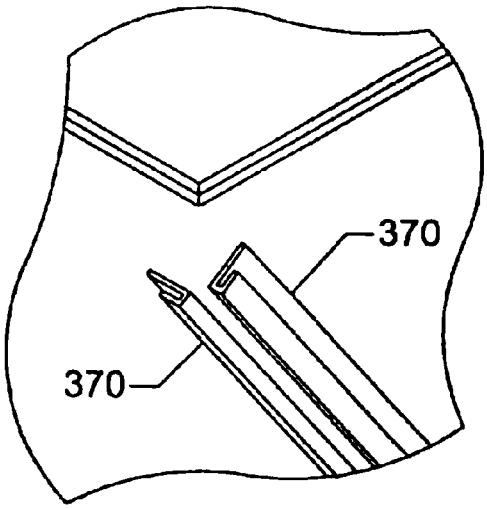
FIG. 11 is a perspective view of a portion of the embodiment of FIG. 10.
Figure 12:
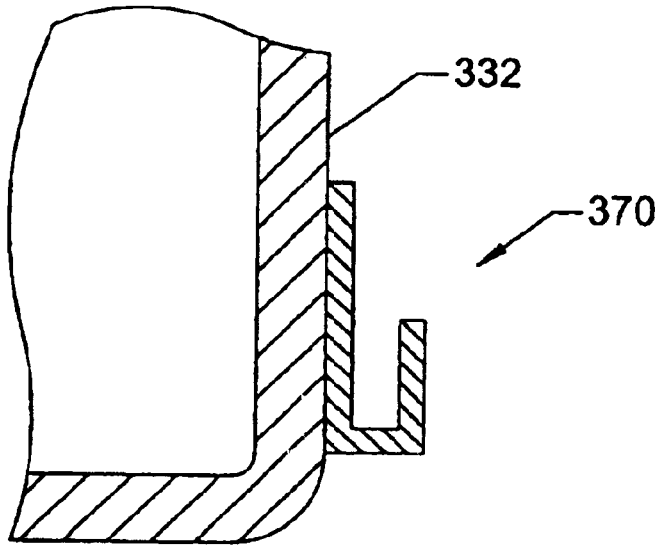
FIG. 12 is a cross section of a channel of the embodiment of FIG. 10.
Figure 13:
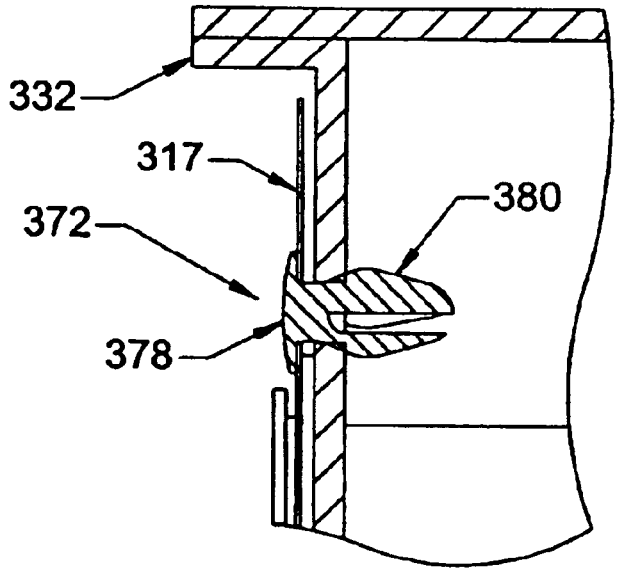
FIG. 13 is a cross section of an inserted push pin of the embodiment of FIG. 10.

FIGS. 8–9 illustrate sign mounts of still additional embodiments of the invention. In particular, the sign mount 112 shown in both FIGS. 8–9 is generally consistent with the sign mount 112 that has been illustrated and discussed in the invention embodiments that have been described herein above. For this reason the same element number has been used. In the embodiments of FIGS. 8–9, however, the display sign of the invention is to be mounted in a ceiling panel that is not configured as a square.

Indeed, it will be appreciated that many suspended or hanging ceilings are configured with a grid pattern that features grids that are shaped in the form of a rectangle with one set of two parallel lattice members 202 forming the long sides, and a second set of two parallel lattice members 204 forming the short sides of the rectangle. It is noted that the lattice members are not part of the present invention, but have been illustrated for clarity. In practice, suspended ceiling grids are often of a "standard" size so that ceiling tiles may be manufactured in large quantities. There are some variations, however, with one example being square grids verses rectangular grids.

In order to effectively be placed in a rectangular grid, other invention embodiments may comprise a sign mount 112 of a substantially square shape with a length that is substantially co-extensive with the short side lattice members 204, as has been illustrated in FIGS. 8–9. This embodiment of the display sign of the invention comprises one or more t-bars 206 for spanning between the two longer lattice members 202. The t-bars 206 when placed between the lattice members 202 are useful for supporting one side of the sign mount 112 as illustrated. To fill the remaining portion of the rectangular shaped ceiling grid, these invention embodiments further comprise at least one diffuser panel 208. As illustrated by FIG. 8, two t-bars 206 and two diffuser panels 208 may be comprised so that the sign mount 112 may be substantially centrally located in the rectangular shaped grid. In the embodiment shown in FIG. 9, only one t-bar 206 and one diffuser panel 208 is provided, with the sign mount 112 thereby being located at one end of the rectangular shaped grid.

Preferably, the diffuser panel 208 is translucent or transparent so that light from an overhead fixture efficiently passes through it. If desired, the diffuser panel 208 may be decoratively designed, and may, by way of example, include coloring, graphics, or signage to complement the signage or graphics illustrated on the display sign. Those skilled in the art will appreciate that the t-bars 206 may be of any useful shape for spanning the two parallel lattice members 202 and supporting the sign display 112. By way of example, the t-bars may comprise a simple flat piece. More preferably, the t-bars 206 comprise an inverted "T" shape for additional structural strength.

Further, it will be appreciated that other invention embodiments may comprise a rectangular shaped sign mount 112 sized to fit in a rectangular ceiling grid. By way of example, those knowledgeable in the art will appreciate that the embodiment shown in FIGS. 8–9 could be easily modified so that the diffuser panels 208 were integral with the sign mount 112.

Still an additional embodiment of the display sign of the invention comprises a motor for urging rotation of the graphics holder suspended below the ceiling. Rotation may be desirable in a substantially continuous fashion about 360°, or in regular or irregular intervals about more limited rotation. By way of particular example of a motorized invention embodiment reference is made to the display sign embodiment 410 of FIGS. 14–15.

Figure 14:
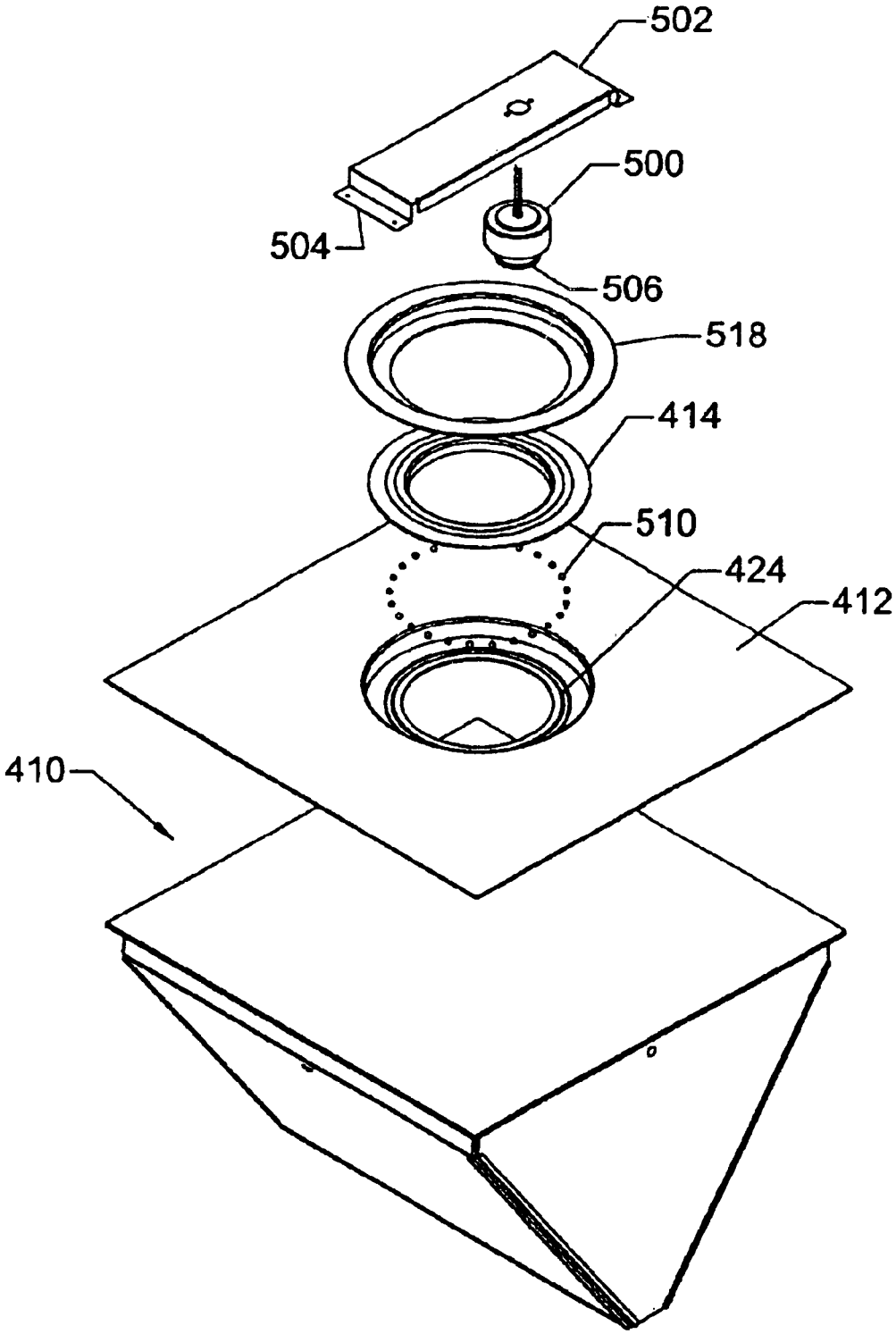
FIG. 14 is an exploded perspective view of an additional invention embodiment.

FIG. 14 is an exploded perspective view of the display sign 410, which is consistent in many elements with sign embodiments discussed herein above. For example, the embodiment 410 comprises a sign mount 412 having a central passage 424 through a bottom wall 426 in which a turntable 414 is rotatably received. In addition to these elements, however, the display sign 410 further comprises a motor 500 for urging rotation of the turntable 414. The motor 500 is mounted on a mounting bracket 502 suspended above the motor 500 and the turntable 414. The mounting bracket comprises legs 504 for attachment to the sign mount 412 at points outside the perimeter of the central passage 424.

The motor 500 may be any conventional motor as are known in the art and commercially available, with compact, lightweight, low cost, and relatively low power motors preferred. The motor 500 is preferably AC powered. Those knowledgeable in the art will appreciate that the motor 500 may have a power connection either facilitated by wiring to the light source (not shown), or directly to an AC source (not shown). A switch may be provided for turning the motor on and off, or the motor may be wired so that it is on and urges rotation of the sign whenever the light source is powered. It will be appreciated that the rotation of the graphic display is preferably at a relatively low RPM, with the result that the drive wheel 506 is preferably operating at a low RPM. For promotional displays, an RPM in the range of about 10 RPM or less may be useful. Those knowledgeable in the art will appreciate that gears or other known mechanisms may be used to result in a suitably low RPM using a motor that operates at a higher RPM.

Figure 15:
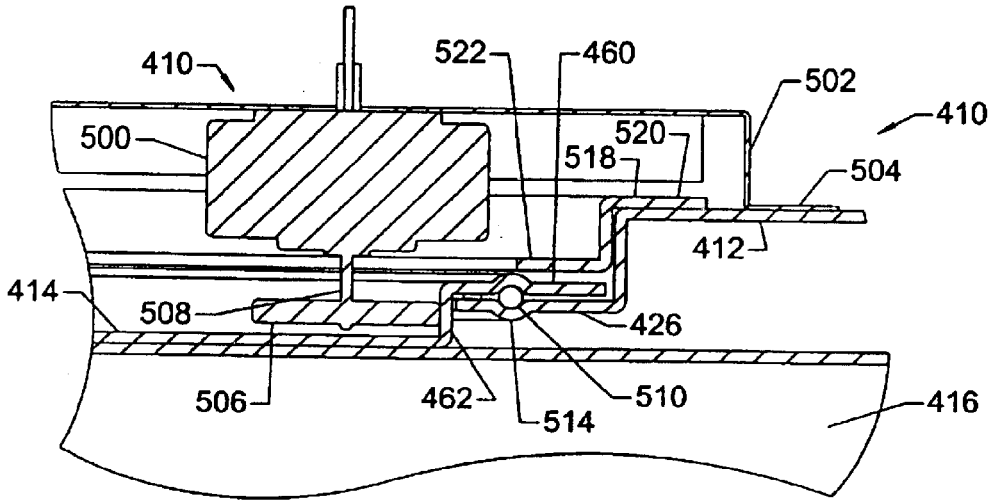
FIG. 15 is a partial cross section of the embodiment of FIG. 14.

The motor preferably comprises a drive wheel 506 connected to a motor drive shaft 508 for frictionally engaging the turntable sidewall 462. The drive wheel 506 and the turntable sidewall 462 may be provided with surfaces facilitating efficient frictional engagement, with a rubber-like surfaces an example. To further facilitate rotation, bearing means such as bearings 510 are preferably provided. The bearings 510 may be rotatably held between an upper race 512 and a lower race 514. The lower race 514 is defined in the bottom wall 426 of the sign mount 412, and is substantially circular extending around the circumference of the central passage 424. The upper race 516 is defined in the top annular shoulder 460 of the turntable, is substantially circular and sized to cooperate with the bottom race 514. As illustrated by FIG. 15, the ball bearings 514, the upper race 516, and the lower race 514 are sized such that the bearings 514 are rotatably held along the races and the top annular shoulder 460 is separated from the bottom wall 426 by some distance to facilitate relatively easy rotation of the display holder 416.

To prevent upward disengagement of the turntable 414 from the sign mount 412 and the resultant disengagement of the bearings 510 that may occur, the display sign 410 has been provided with a retainer for preventing upward disengagement of the turntable 462 from the sign mount 412. Specifically, retaining ring 518 is provided. The retaining ring 518 is substantially circular shaped, and has an annular rim 520 that may be removably or permanently attached to the sign mount 412. The retaining ring 518 further comprises an annular retaining shoulder 522 connected to the rim 520 that is spaced apart from, but placed over the top annular shoulder 460 of the turntable 462 so as to prevent upward disengagement to an extent sufficient to release the bearings 510.

Other embodiments of the invention may comprise other retainers for retaining the turntable in rotational engagement with the sign mount other than the retaining ring 520. Indeed, those knowledgeable in the art will appreciate that a wide variety of retainers that are equivalent to the ring 518 illustrated are possible. By way of example, a plurality of retaining tabs, clips, or shoulders may be connected to the ceiling mount 412 with a distal portion spaced above the turntable top shoulder for retaining the turntable 414. By way of additional example, a retainer may be attached to the motor mount 502, or the motor mount 502 may itself be configured and located to act as a retainer.

Those knowledgeable in the art will appreciate that other embodiments of the display sign of the invention are of course possible with a motor for urging rotation. By way of example, it will be obvious to those knowledgeable in the art that a motor may be used in display sign embodiments that comprise a rectangular, triangular, circular, or other shape using the motor configuration as generally described with reference to the embodiment 410. Further, it will be appreciated that the motor configuration of the embodiment 410 is only one example of a motor configuration that may be practiced within the scope of the present invention.

For example, other manners of mounting the motor may be comprised, such as a cross configuration of members spanning the central passage of the ceiling mount. Further, other drive mechanisms may be comprised within the scope of the invention, including gear drives for engaging gears along the circumference of the turntable, a drive belts for rotationally driving the turntable, and the like.

By way of still additional example, other configurations of rotational bearings may be comprised. By way of particular example, it may be desirable to provide rotational bearings engaged between vertical walls, in addition to or as an alternative to between horizontal walls as shown with reference to the embodiment 410. In particular, an invention embodiment may comprise an inner race defined by the vertical wall of the turntable to cooperated with the vertical wall of the ceiling mount with bearings rotatably engaged therebetween. Under such circumstances, placing the bearings into engagement in the vertically oriented races may be facilitated using a bearing cage assembly such as a roller bearing cage or a ball bearing cage as are known and commercially available.

Further, other invention embodiments may comprise bearings that are rotationally retained on the turntable or on the sign mount for rotational engagement of the turntable or sign mount. Indeed, assembly of the display sign 410 may be made less time consuming through providing alternate bearing assemblies. By way of example, the bearings may be housed in a snap fit race in the turntable top annular shoulder for rotationally engaging the sign mount, retaining clips for rotationally holding roller bearings or the like may be provided, or pre-configured bearing cage assemblies may be used.

In comparing the display sign 410 with the other display sign embodiments that have been described and discussed herein, a few differences between the various embodiments are noteworthy. For example, it is noted that the relative size of the passage 424 is generally smaller than the passage 24 shown in FIG. 1. A smaller passage may be desired when using bearings due to the added difficulty of assembly that use of the bearings can result in. These advantages should be balanced, however, in the disadvantages that the smaller passage may result in associated with reduced light passage.

Also, it is noted that the passage 24 of FIGS. 1 and 5 is defined by a cylindrical rim 52 that rises from the mount bottom wall 26 for engaging the top shoulder 60 of the turntable. The passage 424 of FIG. 15, however, does not comprise a cylinder rim, with the top shoulder 516 instead engaging the bearings 519 rotatably held on the ceiling mount bottom wall 426. Indeed, it will be appreciated that a variety of configurations may be comprised for rotational engagement of the turntable and the ceiling mount.

It will further be appreciated that the present invention is not limited to any particular size of a passage or turntable. By way of example, the present invention could be practiced with only a very small passage through which a bolt-like turntable was held. Further, embodiments of the present invention may comprise turntables that are not rotatable, but that are instead fixedly attached or even integral with the sign mount, with a graphic holder then rotatably attached to the fixed turntable. Also, the turntable may be integral with the graphic holder, as was shown, for example, in the embodiment 100. Accordingly, it will be appreciated that as used herein the term "connected to" or "held" when used in reference to the turntable being connected to the graphic holder encompasses a condition of being integral with.

It is also noted that the passage 424 is surrounded by a portion of the sign mount bottom wall 426 that is "dropped" below the remaining portion of the bottom wall 426, so as to form an annular rim for receiving the turntable shoulder 460. This particular recessed annular rim configuration of the display sign 410 may be desirable to create more space for the motor 500.

In a similar manner, it will be noted that the ceiling mount 12 illustrated in FIG. 1 comprises a bottom wall 26 that is "dropped" below the mount edges 22 that engage the ceiling grid members. That is, the mount 12 comprises a side wall 54 as shown in FIG. 5 that has the effect of lowering the bottom wall 26. The ceiling mount 412 of FIG. 14, however, is substantially flat. It will be appreciated that either configuration may be practiced within the scope of the invention. While a substantially flat ceiling mount may be less expensive to manufacture, a "recessed" mount having a lowered bottom wall may provide for increased interior clearance for a motor, wiring, existing sprinkler heads, pipes, and the like.

Those skilled in the art will appreciated that the display sign of the invention may comprise many other variations within the scope of the invention. By way of example, an additional display light may comprise an AC or DC powered light source for illuminating the graphics holder so that the display light is not limited to being mounted in a ceiling grid below an existing light fixture. Still an additional invention embodiment may comprise a display sign having a plurality of graphics holders suspended from a single ceiling mount. Indeed, the embodiments illustrated and described herein have been presented only to illustrate the various features of the invention in the best presently known manner of practicing the invention. Accordingly, the embodiments described herein shall not be read to be a limitation on the claims appended hereto.

What is claimed is:

1. A display sign for suspension from a ceiling of the type that has a plurality of ceiling grids, an electrical light source held above one of the grids, the display sign comprising:

a sign mount adapted for mounting in the one of the ceiling grids with the light source held above it, said sign mount having a passage configured to allow light to pass through it from the light source;

a turntable held in said sign mount passage and having an open interior portion coincident with at least a portion of said sign mount passage whereby light may pass from the light source through said passage and through said open interior portion, said turntable having a top shoulder engaging said sign mount and an annular side wail descending from said top shoulder; and, a graphic holder for displaying graphics connected to said turntable and rotatably suspended below said sign mount, said graphic holder having an interior and a top wall with an open portion that is at least partially coincident with said turntable open portion whereby light from the light source may pass from said turntable open portion through said top wall open portion and into said graphic holder interior.

2. A display sign for mounting in a ceiling of the type that has a plurality of ceiling grids defined by regularly spaced lattice members, the display sign comprising:

a sign mount having four edges, at least two of said edges for engaging at least two of the ceiling lattice members whereby the sign mount may be mounted in one of the ceiling grids, said sign mount having a bottom wall with a circular passage therethrough;

a turntable rotatably held in said sign mount passage, said turntable having a top shoulder for rotatably engaging said sign mount bottom wall, an annular side wall descending from said top shoulder, said annular side wall having a diameter smaller than the diameter of said passage, a bottom shoulder attached to said annular side wall; and, a graphic holder connected to said turntable bottom shoulder and rotatably suspended below said sign mount for 360° rotation, said graphic holder comprised of a translucent material, said graphic holder having at least one sidewall, a graphic sheet removably attached to said at least one sidewall.

3. A display sign as defined by claim 2 wherein said sign mount comprises a shoulder about its four edges for engaging the ceiling lattice members, a side wall descending from said shoulder, said bottom wall connected to said side wall, a cylindrical rim wall rising from said bottom wall to define said passage, and said turntable top shoulder being annular and rotatably engaging the top of said cylindrical side wall.

4. A display sign as defined by claim 2 wherein said graphic holder has a plurality of sidewalls, at least two of said sidewalls descending from said turntable in a narrowing angle relative to one another so that the bottom edges of said at least two sidewalls are nearer to one another than are top edges of said at least two sidewall, said at least two sidewalls having at least one channel along one of said edges for receiving and removably retaining an edge of said graphics sheet.

5. A display sign for suspension from a ceiling of the type that has a plurality of ceiling grids, the display sign comprising:

a sign mount adapted for mounting in one of the ceiling grids, said sign mount having a substantially circular passage;

a turntable held in said sign mount passage having a top shoulder for rotatably engaging said sign mount proximate said passage, said turntable having an annular side wall descending from said top annular shoulder, said annular side wall having a diameter less than the diameter of said circular passage; and, a graphic holder for displaying graphics connected to said turntable and rotatably suspended below said sign mount.

6. A display sign as defined by claim 5 wherein the ceiling grids are defined by ceiling lattice members, and wherein said sign mount has four substantially straight sides, each of said four sides having a shoulder adapted for abutting a ceiling lattice member, a side wall descending from said shoulder, a bottom wall connecting said side walls, said passage passing through said bottom wall.

7. A display sign as defined by claim 5 wherein said graphic holder comprises a top wall, two end panels and two side panels, and said top wall being connected to said turntable.

8. A display sign as defined by claim 7 wherein said end panels descend from said top wall in a narrowing and generally V shape whereby the bottom edges of said side panels are nearer to one another than said top edges are, said side panels for displaying graphics messages.

9. A display sign as defined by claim 5 wherein said graphic holder has a side wall, said side wall has a channel along at least one edge for removably holding a graphics sheet.

10. A display sign as defined by claim 5 wherein said turntable may be rotated 360°.

11. A display sign as defined by claim 5 further comprising a light source for illuminating said graphics holder.

12. A display sign as defined by claim 5 wherein said graphic holder and said sign mount are comprised of a translucent material.

13. A display sign for suspension from a ceiling of the type that has a plurality of ceiling grids, the display sign comprising:

a sign mount adapted for mounting in one of the ceiling grids, said sign mount having bottom wall with a passage therethrough, a rim wall rising vertically from said bottom wall and defining the perimeter of said passage;

a turntable held in said sign mount passage and having a top shoulder for rotatably engaging the top of said rim wall; and, a graphic holder for displaying graphics connected to said turntable and rotatably suspended below said sign mount.

14. A display sign as defined by claim 13 wherein said sign mount passage is substantially circular, said top shoulder is annular, and wherein said turntable has an annular side wall descending from said top annular shoulder passing through said passage, said side wall having a smaller diameter than the diameter of said passage whereby said annular side wall is separated from said sign mount rim wall by a distance, a bottom shoulder connected to said annular side wall, said graphic holder connected to said bottom shoulder.

15. A display sign as defined by claim 14 wherein said bottom shoulder comprises connection means for removably connecting said graphics holder.

* * * * *